US006401269B1

(12) United States Patent
Andersen et al.

(10) Patent No.: US 6,401,269 B1
(45) Date of Patent: Jun. 11, 2002

(54) FLAPPER VALVE WITH DUAL ACTION ARM

(75) Inventors: Terrence J. Andersen, Saukville; David K. Rische, Sheboygan, both of WI (US)

(73) Assignee: Kohler Co., Kohler, WI (US)

( * ) Notice: Subject to any disclaimer, the term of this patent is extended or adjusted under 35 U.S.C. 154(b) by 0 days.

(21) Appl. No.: 09/811,026

(22) Filed: Mar. 16, 2001

(51) Int. Cl.[7] ..... E03D 1/35
(52) U.S. Cl. ..... 4/393; 4/379; 4/386
(58) Field of Search ..... 4/393, 379, 386, 4/392, 402, 403, 404

(56) References Cited

U.S. PATENT DOCUMENTS

| | | | | | |
|---|---|---|---|---|---|
| 381,911 | A | * | 5/1888 | Crawford | 4/386 |
| 1,201,416 | A | * | 10/1916 | Ziemer | 4/386 |
| 1,298,012 | A | * | 3/1919 | Crane | 4/386 |
| 3,072,919 | A | | 1/1963 | Roach | |
| 3,341,863 | A | * | 9/1967 | Schultz et al. | 4/386 |
| 3,988,785 | A | | 11/1976 | Schoepe et al. | |
| 4,028,748 | A | | 6/1977 | Schoepe et al. | |
| 4,134,165 | A | | 1/1979 | Phripp et al. | |
| 4,365,365 | A | | 12/1982 | Antunez | |
| 4,455,694 | A | * | 6/1984 | Dymon | 4/393 |
| 5,179,739 | A | * | 1/1993 | Mann | 4/379 |
| 5,291,620 | A | | 3/1994 | Gilley | |
| 5,794,279 | A | | 8/1998 | Schwartz | |
| 5,848,442 | A | | 12/1998 | Denzin | |

* cited by examiner

*Primary Examiner*—Charles R. Eloshway
(74) *Attorney, Agent, or Firm*—Quarles & Brady LLP

(57) ABSTRACT

A flapper valve assembly for regulating the passage of water from a toilet tank is provided with a structure to reduce overflow risk. There is a yoke pivotally disposed in the tank and supporting a flapper seal that can be seated on and unseated from the flush opening. A flapper arm has a first segment coupled to the yoke along a pivot axis and a second segment extending away from the pivot axis toward the flapper seal. The flapper arm is configured such that it delays seating of the flapper seal when the water in the tank is above a predetermined level and assists seating of the flapper seal when the water is below a designated level.

7 Claims, 3 Drawing Sheets

FLAPPER VALVE WITH DUAL ACTION ARM

STATEMENT REGARDING FEDERALLY SPONSORED RESEARCH/DEVELOPMENT

Not applicable.

CROSS-REFERENCE TO RELATED APPLICATION

Not applicable.

BACKGROUND OF THE INVENTION

The present invention relates to flush valves that control the flow of water from toilet tanks to toilet bowls, and in particular, to flush valves providing improved protection against overflows from toilet bowls.

A variety of systems are known for controlling the flush of toilet tank water to a toilet bowl. See e.g. U.S. Pat. Nos. 3,072,919, 3,988,785, 4,365,365, 5,794,279 and 5,848,422. Most of these systems include an outlet near the bottom of the toilet tank with a trip-activated flapper valve positioned adjacent the outlet. There is also an inlet valve for the tank that is typically controlled by a float that senses tank water level.

Depressing a trip lever raises the flapper, thereby unsealing the outlet so that water can empty from the tank into the bowl. As the tank water drains, the inlet valve float drops with the water level in the tank, thereby triggering inlet water flow. However, normally the water level drops faster than the inlet water enters. The flapper then can drop down to reseal the outlet, and the water level in the tank can be re-established. As the tank refills, the inlet valve float rises with the water and eventually closes the inlet valve to shut off the incoming water.

However, if the bowl trap were to be become obstructed, water from the tank would flood into the bowl through the rim openings and fill the bowl. The obstruction would prevent the bowl from emptying, and the water in the bowl would rise to the rim level.

If the outlet opening were positioned sufficiently high above the rim level, this would not interfere with the tendency of the flapper to reseal. However, if the outlet opening were positioned at or below the rim level, as might be desired in the design of an extremely low profile toilet to preserve tank water capacity, this might prevent the flapper from resealing. This could lead to an overflow condition (as in the absence of the flapper closing the outlet, the inlet water valve will not shut off).

Thus, a need exists for improved overflow protection in connection with flapper valves used for low profile toilets.

SUMMARY OF THE INVENTION

In one form, the invention provides a flapper valve assembly for regulating the passage of water out from a toilet water tank. The tank is of the type having a lower outlet opening. There is a flapper seal for seating against a seal surface of the outlet opening, and an attachment site for attaching a trip connector adjacent the flapper seal. There is also a yoke supporting the flapper seal adjacent an outer end of the yoke, and having a pivot axis adjacent an inward end of the yoke. A flapper arm has a first segment connected to the yoke adjacent the pivot axis, and a second segment extending at least partially in an outward direction.

In preferred forms the second segment of the flapper arm has a U-bend in it, or is otherwise provided with extra weight. When the flapper seal is horizontal, the second segment preferably extends at between 30 degrees and 60 degrees from vertical. The above assembly is particularly well suited for use when the flapper seal has an inner cavity and is supported by a yoke having a pair of legs (each having an opening defining the pivot axis).

In another aspect the invention provides a toilet tank. There is a tank housing with a lower outlet and a flapper seal pivotably positioned adjacent the outlet to control flow out the outlet. There is also a flapper arm coupled to the seal. The flapper arm is configured such that it delays seating of the flapper seal against the outlet when the water in the water tank is above a first specified level and assists seating of the flapper seal against the outlet when the water is either below that first specified level, or a second lower level.

The invention provides a flapper valve assembly that can be retrofit onto existing toilets to reduce the incidence of overflow. The flapper valve assembly can also be incorporated into newly designed toilets that have lower drain outlets.

As will be appreciated from the following, a primary aspect of the invention is the provision of a weighted element that is above the flapper when the flapper is horizontal or near horizontal. It can therefore help drive the flapper down even when there is some residual water in the tank (e.g. due to a bowl overflow condition). However, when the flapper is angled upward to a sufficient extent, the primary arm weight is shifted to an opposite side of a pivot axis. In this position, the arm retards flapper closure, thereby avoiding premature closure of the valve when the toilet tank hasn't completely emptied (during normal operation).

Advantages of the present invention therefore include:

(a) reducing the risk of an overflow from toilets;

(b) permitting toilets to be designed with lower profiles while retaining adequate water capacity for proper cleaning cycles; and (c) providing flapper assemblies of the above kind which can be retrofit into existing toilets. These and other advantages of the invention will be apparent from the detailed description and drawings.

DETAILED DESCRIPTION OF THE PREFERRED EMBODIMENT

Figure 1:
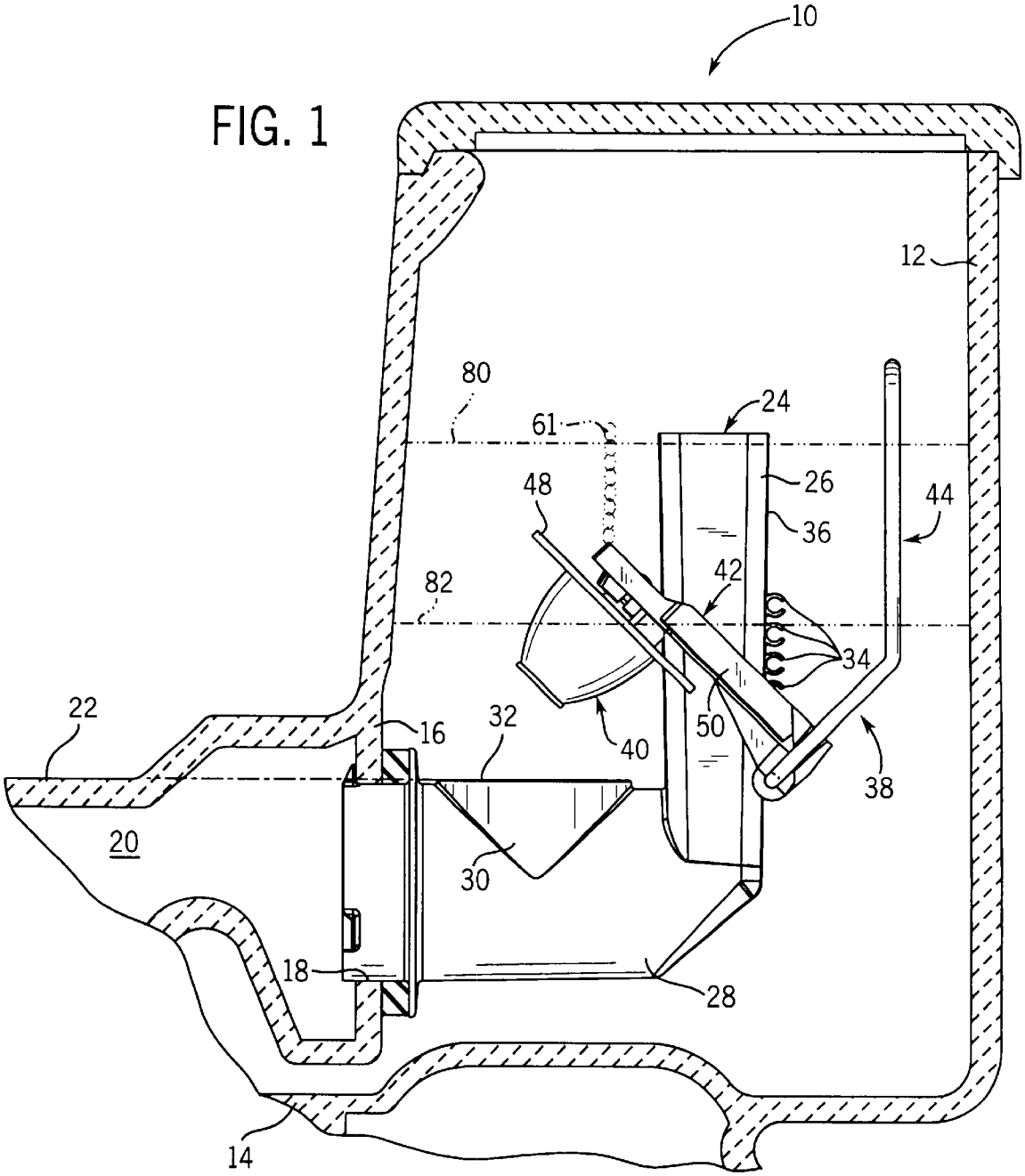
FIG. 1 is a side view showing a flapper assembly of the present invention mounted in a low profile, one-piece type toilet.

Referring now to FIG. 1, a "one-piece" type low profile toilet 10 includes a water tank 12 and a bowl section 14. The tank 12 has a lower vertical wall 16 with an outlet opening 18 leading to a channel 20 in an upper rim 22 of the bowl 14.

The flush valve assembly 24 has an overflow tube 26 disposed vertically upright in the tank 12. It is connected to a horizontal extension tube 28 that is suitably coupled to the vertical wall 16 at the outlet opening 18. See e.g. U.S. Pat. No. 5,848,442 for an example of a preferred coupling technique.

The horizontal section 28 has a cylindrical flush opening 30, the upper edge of which provides a seal surface 32. The seal surface 32 is preferably located near, at or even below the height of the bowl rim 22.

Back wall 36 of the overflow tube 26 includes a plurality of vertically spaced clip members 34 for attaching the flapper valve assembly 38 of the present invention. The multiple clip members 34 allow the flapper valve assembly 38 to be attached at different heights, depending on the design of the toilet tank. Again, see generally U.S. Pat. No. 5,848,442 for a discussion of the design and function of such clips.

Figure 3:
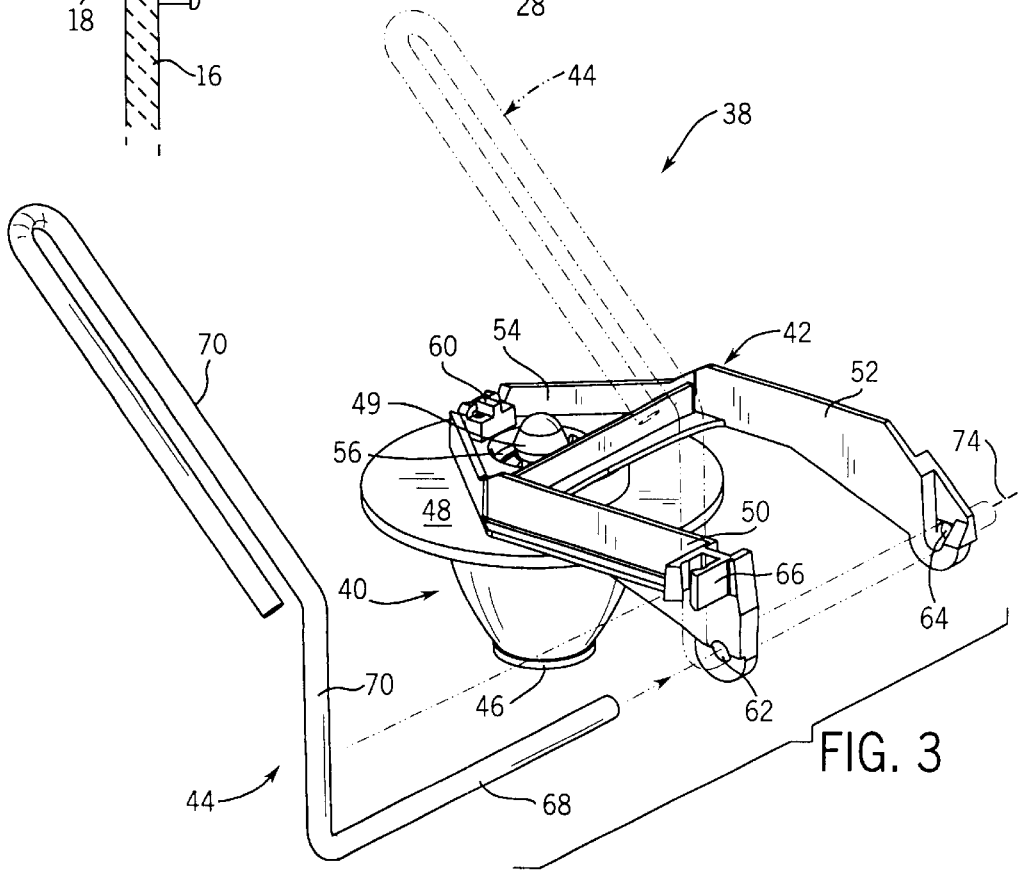
FIG. 3 is a rear perspective view of the flapper assembly, with a flapper arm shown disassembled.
Figure 4:
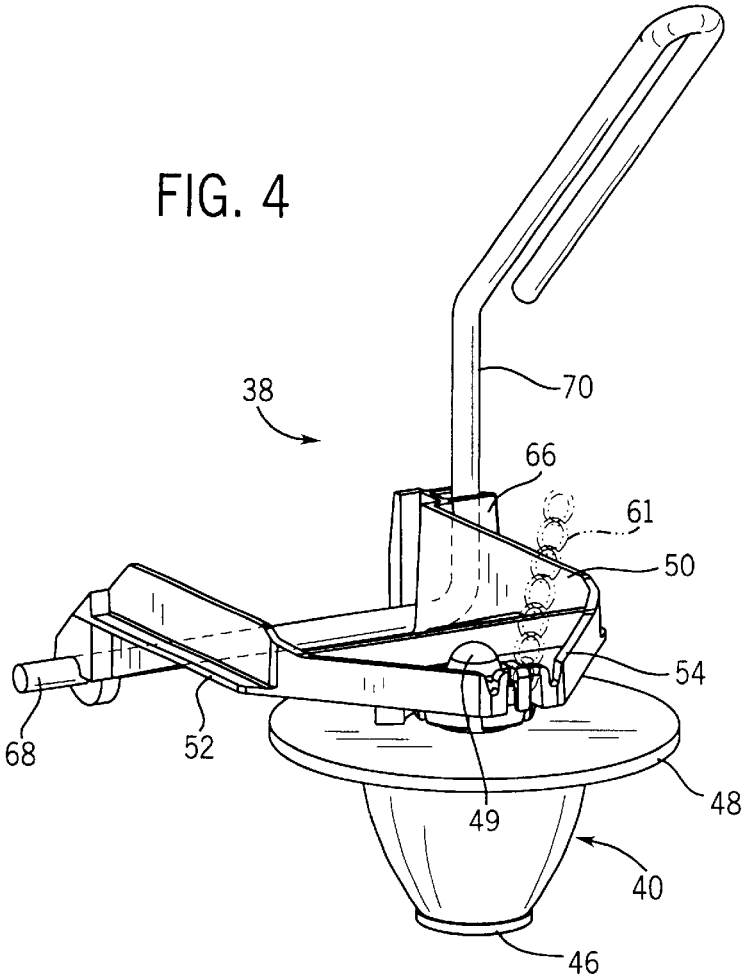
FIG. 4 is a front perspective view of the flapper assembly, with a trip lever chain attached thereto shown in phantom.
Figure 5:
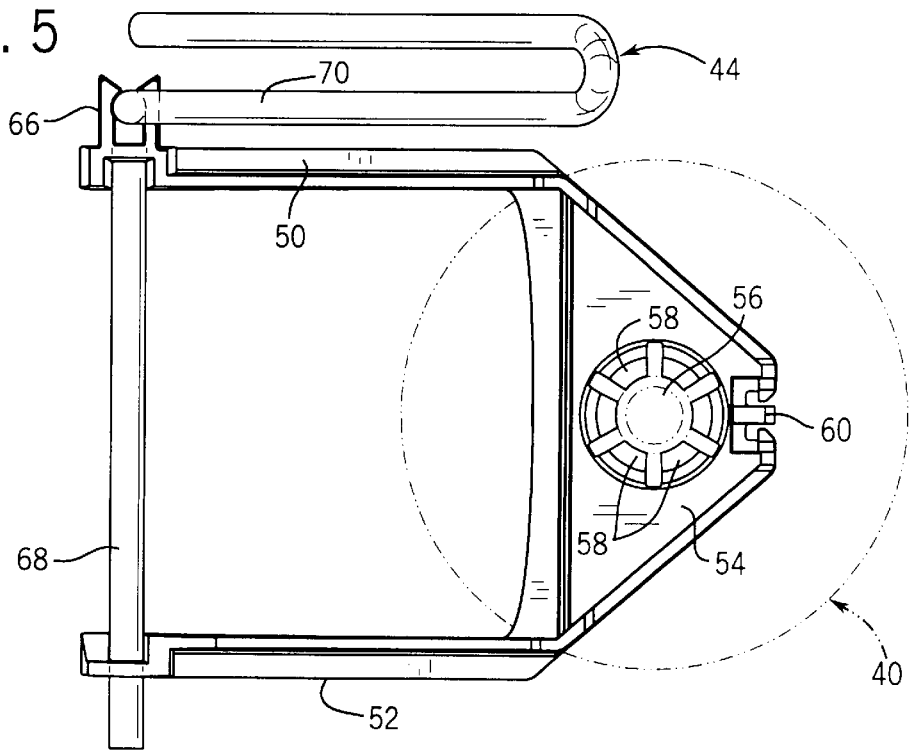
FIG. 5 is a top view of the flapper assembly with the flapper seal shown in phantom.

As best shown in FIGS. 3–5, the flapper valve assembly 38 includes a flapper seal generally 40 supported by a yoke 42, to which is attached a unique flapper arm 44. The seal 40 is preferably made of an elastomeric material (e.g. rubber) defining a generally conical body with a hollow interior cavity open to the atmosphere through an opening (not shown) in a cap 46 at the bottom of the flapper seal 40. At its top, the flapper seal 40 has a ring 48 for sealing with the seal surface 32 of the flush opening 30, and a tapered boss 49 for snap connecting the flapper seal 40 to the yoke 42. A preferred flapper seal 40 is commercially available from Fluidmaster, Inc. of San Juan Capistrano, Calif. See also the flapper seal of U.S. Pat. No. 3,988,785.

The yoke 42 is preferably made of 20% talc-filled polypropylene and has a pair of parallel legs 50 and 52 interconnected at one end by a somewhat triangular section 54 having an opening 56 there through. There are flexible inwardly extending fingers 58 for snapping onto a boss 49 on the flapper seal 40.

At the tip of the triangular section 54 is a recessed projection or attachment site 60 for attaching a chain 61. The chain is coupled at its opposite end to the flush trip lever (not shown), with the lever being accessible in the usual manner from outside of the tank 12. At the end of the legs 50 and 52 opposite the triangular section 54 are openings 62 and 64, respectively, and a vertical clip member 66 (at the end of leg 50 only) for connecting the flapper arm 44.

The flapper arm 44 is preferably a 0.188 diameter 300 series stainless steel rod bent into two segments, 68 and 70. The first segment 68 is straight and attaches the flapper valve assembly 38 to the flush assembly 24 by fitting the yoke legs 50 and 52 around the front of the overflow tube 26 and inserting the first segment 68 of the flapper arm 44 through the openings 62 and 64 and into a selected clip member 34 at the back wall 36 of the overflow tube 24.

The second segment 70 bends in a first direction and then angles away at approximately 45 degrees. The outer portion of the segment 70 is bent in a hairpin so that there two generally parallel runs of the rod. The purpose of this is to skew the weight of the arm towards this portion of the arm.

Figure 2:
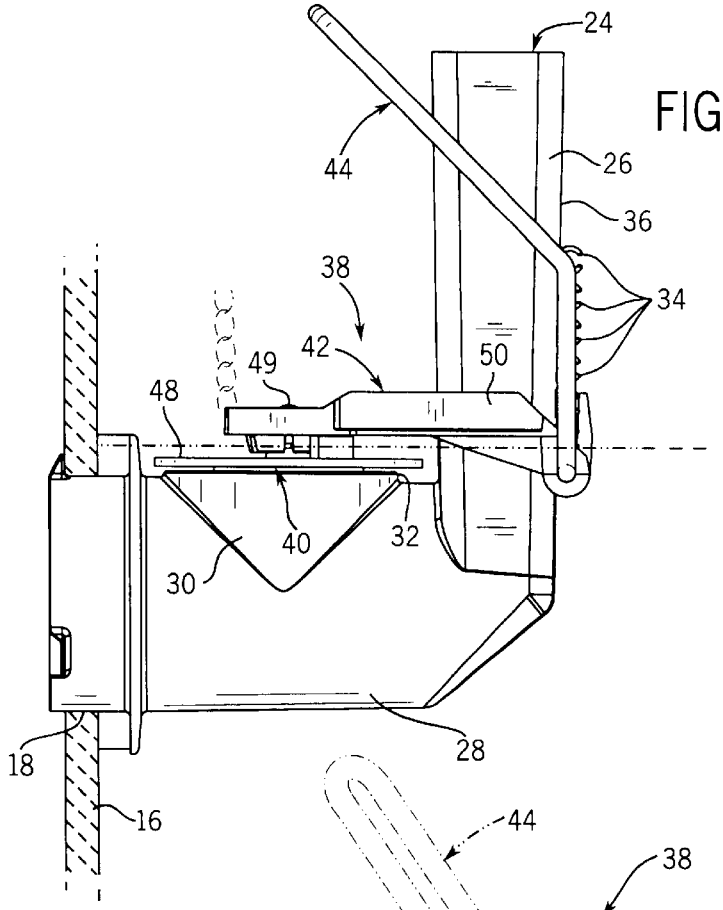
FIG. 2 is a view similar to a part of FIG. 1, albeit with the flapper assembly shown seated.

Prior to performing a flush operation, the flapper valve assembly 38 is in the position shown in FIG. 2, with the flapper seal 40 seated on the seal surface 32 of the flush opening 30. The water level in the tank 12 at this point is shown in FIG. 1 by upper dotted line 80. Depressing the trip lever (not shown) causes the chain 61 to become taught and pull the yoke 42 upwardly sufficient to cause it to pivot about pivot axis 74 (see FIG. 3), and unseat the flapper seal 40, as shown in FIG. 1.

The flapper seal 40 is initially held up by the buoyancy force of the water acting on the flapper valve assembly 38 plus (and importantly) the weight of the flapper arm 44, which provides a countervailing moment on the flapper seal 40 (via the yoke 42) because its center of mass is at this point on the opposite side of the pivot axis 74. While the flapper valve assembly 38 is in the position shown in FIG. 1, water in the tank 12 can flow through the flush opening 30, extension tube 28, outlet opening 18, rim channel 20 and rim openings (not shown).

When the water drains to water level line 82 of FIG. 1, which in the depicted embodiment is well above the height of the bowl rim 22, the weight of the flapper arm 44 is still opposing the tendency of the flapper to close. Thus, it still slightly delays closure so that the water can empty from the tank. However, the weight is not sufficient to prevent the flapper from dropping. It is only sufficient to retard the rate. Accordingly, the flapper valve assembly 38 continues to pivot until the weight of the flapper arm is more to the side of the flapper than to the opposite side.

As it pivots, the weight of the bent segment of the flapper arm 44 begins to transfer from behind, to in front of, the pivot axis 74. This occurs above the top level of the rim, and below level 82. At this point, the flapper arm goes from opposing the seating of the flapper seal 40 to assisting it.

Thus, the dual action flapper arm 44 first delays and then positively assists seating of the flapper seal 40. Once seated, the tank 12 and bowl 14 can be refilled by supply water, which is shut off by a suitable valve, such as a float operated inlet valve assembly.

Water and waste in the bowl 14 is evacuated to plumbing waste lines in the usual manner through a trap. If the trap were to become obstructed, the contents of the bowl 14 might not drain. The bowl contents could then rise up to the rim 22, causing some water to remain in the tank. Such an occurrence might stop the flapper from reseating in certain conventional systems. Because the tank 12 could then not refill, the water level in the tank could not rise, and the inlet valve assembly would not shut off the incoming water supply. This could cause water to continuously pour over the bowl rim 22 and onto the floor until the water is shut off manually.

The flapper valve assembly 38 of the present invention is designed to reduce the risk of such an occurrence. Should some water remain in the tank, the weight of the flapper arm will still be sufficient to drive the flapper into closure, thus permitting water in the tank to rise and the inlet water to be shut off.

The invention therefore provides a toilet with reduced overflow risk for any given tank height. Moreover, the system is designed to be suitable to either retrofit to existing drains, or to be incorporated into new toilets. The feature that provides the protection has very low cost, and is easy to manufacture and assemble.

A preferred embodiment of the invention has been described above. Modifications and variations to the preferred embodiment are within the spirit and scope of the invention. Therefore, the invention is not to be limited to the described embodiment. To ascertain the full scope of the invention, the following claims should be referenced.

We claim:

1. A flapper valve assembly for regulating passage of water out from a toilet water tank, the tank having a lower outlet opening, the assembly comprising:

a flapper seal for seating against a seal surface of the outlet opening;

an attachment site for attaching a trip connector adjacent the flapper seal;

a yoke supporting the flapper seal adjacent an outer end of the yoke, and having a pivot axis adjacent an inward end of the yoke; and a flapper arm for delaying and assisting the seating of the flapper seal, said flapper arm having a first segment connected to the yoke adjacent the pivot axis, and a second segment extending at least partially in an outward direction, said second segment being bent so as to increase its weight relative to the first segment and thereby skew the weight of the flapper arm towards the second segment.

2. The flapper valve assembly of claim 1, wherein the second segment of the flapper arm has a U-bend in it.

3. The flapper valve assembly of claim 2, wherein the second segment contains extra weight for a given length of the segment.

4. The flapper valve assembly of claim 1, wherein the flapper arm is a metal rod.

5. The flapper valve assembly of claim 1, wherein when the flapper seal is horizontal, the second segment extends at between 30 degrees and 60 degrees from vertical.

6. The flapper valve assembly of claim 1, wherein the flapper seal has an inner cavity.

7. The flapper valve assembly of claim 1, wherein the yoke includes a pair of legs each having an opening defining the pivot axis.

* * * * *